US005281185A

United States Patent [19]

Lee

[11] Patent Number: 5,281,185

[45] Date of Patent: Jan. 25, 1994

[54] UNIVERSAL FOLDABLE TOY BLOCKS WITH ALIGNABLE SLOTS

[76] Inventor: Robert W. Lee, 9120 Vanderbilt Dr., Naples, Fla. 33963

[21] Appl. No.: 20,717

[22] Filed: Feb. 22, 1993

[51] Int. Cl.[5] ..... A63H 33/00; A63H 33/04; A63H 33/08

[52] U.S. Cl. ..... 446/488; 446/85; 446/109

[58] Field of Search ..... 446/85, 86, 108, 109, 446/111, 112, 113, 114, 115, 116, 121, 122, 487, 488

[56] References Cited

U.S. PATENT DOCUMENTS

| | | | |
|---|---|---|---|
| 101,179 | 3/1870 | Swift | 446/122 |
| 1,604,391 | 10/1926 | Crey | 446/488 X |
| 1,718,230 | 6/1929 | Graves | 446/116 |
| 2,751,705 | 6/1956 | Joseph | 446/488 X |
| 2,874,512 | 2/1959 | Joseph et al. | 446/487 X |
| 2,940,760 | 6/1960 | Brinkman, Jr. | 446/85 X |
| 3,368,316 | 2/1968 | Crowder | 446/109 X |
| 3,581,431 | 1/1971 | Trenovan | 446/488 X |
| 3,855,748 | 12/1974 | Thomas | 446/115 X |
| 4,608,799 | 9/1986 | Hasegawa | 446/488 X |
| 5,125,867 | 6/1992 | Solomon | 446/488 |
| 5,162,010 | 11/1992 | Krebs | 446/112 |

FOREIGN PATENT DOCUMENTS

| | | | |
|---|---|---|---|
| 925578 | 3/1955 | Fed. Rep. of Germany | 446/109 |
| 2131688 | 12/1972 | Fed. Rep. of Germany | 446/122 |
| 2913905 | 10/1980 | Fed. Rep. of Germany | 446/86 |
| 2239083 | 2/1975 | France | 446/108 |
| 2488517 | 2/1982 | France | 446/112 |

*Primary Examiner*—David N. Muir

[57] ABSTRACT

Various toy building blocks, various connecting members and a variety of panels which combine to form a unique system for the creative enjoyment of children of all ages. Various patterns for the blocks would be formed out of a substantially flat semi-rigid material having a uniform thickness. These patterns would be folded by the end user, using fold lines incorporated into the patterns, so as to form blocks. These would include the basic cube and longer blocks that would be some multiple of the basic cube. Also included would be five sided blocks which are one half the size of a basic cube. All of the blocks would have slots at uniformly spaced points which would allow the insertion of connecting pieces which would be formed of a resilient, and therefore slightly compressible, material. These connectors would be slightly thicker than the width of the slots. This would allow for a tight fit which, based on friction, would hold the various blocks together. The blocks would be shipped and distributed in their flat condition and assembled into the three dimensional shapes by the end user. The blocks could be unfolded for storage when not in use. One advantage of the system is that it would allow children to express their creativity on a large scale while eliminating the danger associated with solid, and therefore heavier, blocks of a similar size. The system would allow children of all ages to enjoy many hours of creative fun.

11 Claims, 10 Drawing Sheets

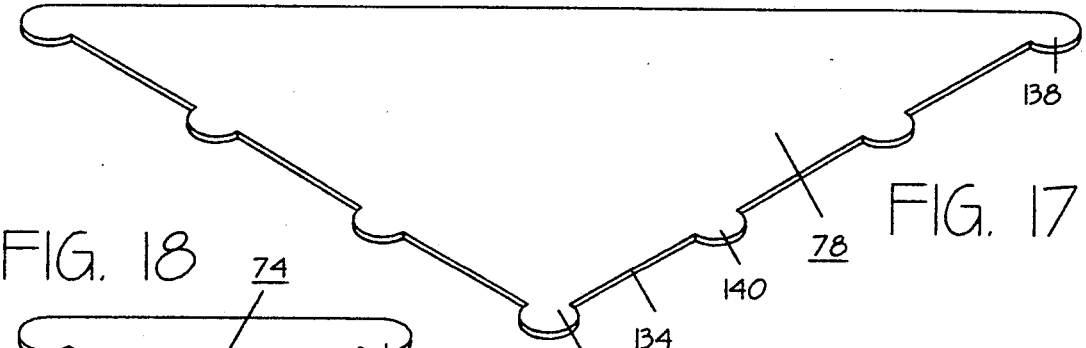
FIG. 17
FIG. 18
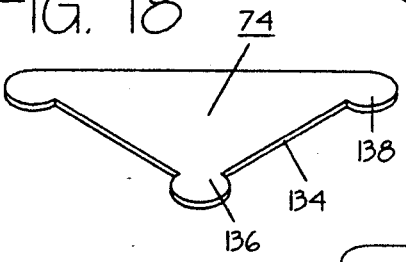
FIG. 19
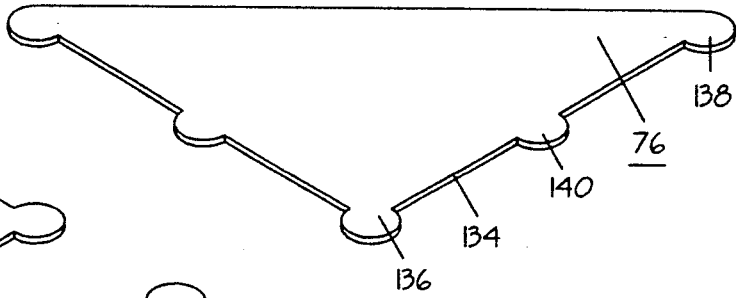
FIG. 20
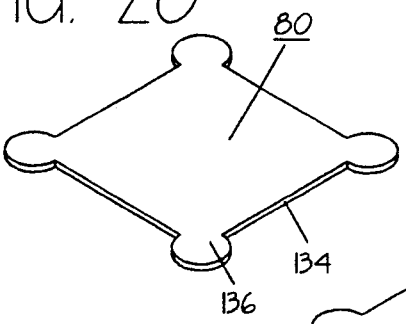
FIG. 21
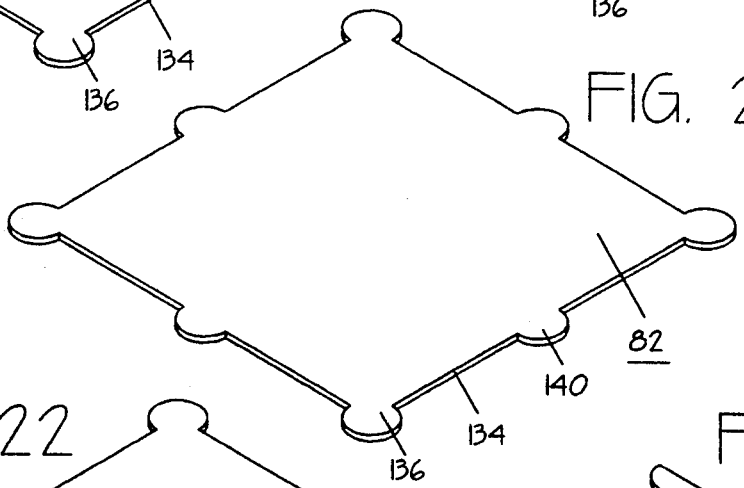
FIG. 22
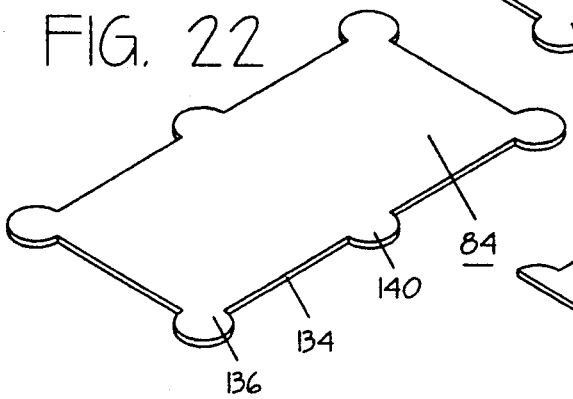
FIG. 23
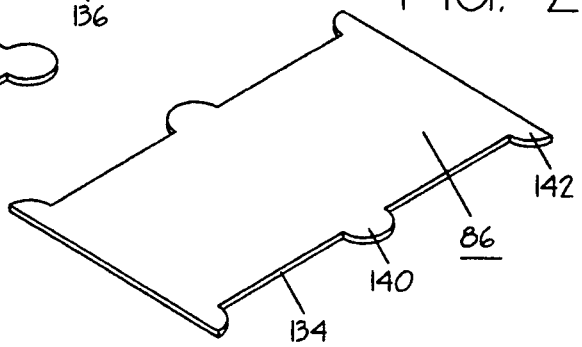

UNIVERSAL FOLDABLE TOY BLOCKS WITH ALIGNABLE SLOTS

BACKGROUND OF THE INVENTION

1. Field of the Invention

This invention relates to a system of toy blocks and accessories which are constructed of a material that would be substantially flat, semi rigid and have a consistent thickness such as cardboard, plastic or foam. Various patterns would be cut out of this material to form the parts of the system that become the blocks and attaching panels. The patterns that become the blocks would be such that various slots are cut in the patterns and these slots would go completely through the patterns. The patterns would also have a series of distinct fold lines which would be manufactured into the patterns. These fold lines would be in the form of sharp creases or partial cuts at the desired locations. By folding the patterns at these fold lines and inserting various extending tabs into the appropriate locations, the patterns fold into the three dimensional entities. The system will also include various pieces which have the function of connecting and holding the plurality of blocks together to form building projects.

There has always been a need for toys that inspire creativity and discovery by the children that play with them. This invention seeks to fulfill that need by allowing children to construct projects out of the various components of the system that would be limited only by their individual imagination. As the child plays with and discovers more about the unique connectability of the blocks and accessories he or she would grow intellectually.

2. Brief Description of the Prior Art

There has always been a need for toys that would keep children amused and occupied for relatively long periods of time. In the art we find many examples of toy building blocks that have attempted to fulfill the needs of the child.

The toy blocks forming the current art fall into two broad groups. The first group includes toy blocks that have the characteristic of being rigidly connectable to each other. The second group comprises the blocks that are stackable without the ability to be rigidly connected to each other.

The first group is characterized by connecting members comprised of two opposing connectors which fit together to hold the blocks rigidly together. Usually these connectors are built into the one piece block and therefore the connectors are not detachable. When the connecting member is not built into the block, it is in the form of a peg designed for insertion into a hole bore into the blocks.

The second group, that is the group without the ability to be rigidly connected together, is comprised of blocks of many sizes and many shapes. They may be solid or hollow and constructed of a variety of materials. The projects built from these blocks are assembled by stacking the blocks on each other. There are various projects which can be built with these blocks, although they all lack the rigidity required by small children. The structures being built have the tendency to collapse and the project under construction must be abandoned.

SUMMARY OF THE INVENTION

An object of the invention is to provide a new and unique system of toy building blocks for the enjoyment of children of all ages.

Another object of the invention is to provide a new concept for the alignment and connection of the various blocks in the system.

Still another object of the invention is to provide a system of building blocks were the individual blocks are relatively large. This will allow the child to build a structure with them that will be of sufficient proportions, to the child, so as to allow the child to interact with the structure.

Yet another object of the invention is to provide for individual building blocks, which when assembled, are hollow, and therefore relatively light for their physical size. This would allow the means to accommodate children of all ages while reducing the dangers of heavy building blocks.

A further object of the invention is to provide a system for the connection of the individual components of the system to allow for the construction of sturdy structures which will not collapse during the construction thereof by the child.

Another object of the invention is to provide the safest and most healthful program possible. The danger associated with current building blocks which have small parts which a child could attempt to swallow is eliminated.

Still another object of the invention is to provide a system which can be unfolded when not in use for ease of storage.

Yet another object of the invention is to stimulate imagination and excitement that will create more productive adults.

A further object of the invention is to help develop hand motor skills.

Another object of the invention is to provide children with a program where the ease of use will allow use with little explanation, direction or supervision from adults.

Still another object of the invention is to provide for a program that will occupy children in a quiet project.

Yet another object of the invention is to fulfill the curiosity which children have in abundance.

A further object of the invention is to substantially reduce the anxiety experienced by children during the construction of large projects constructed from building blocks which are not interlocking.

Another object of the invention is to provide a therapeutic aid to improve the dexterity and coordination of older people. This would be provided by the light weight building blocks and ease of construction of the invention.

Still another object of the invention is to aid in the rehabilitation of stroke victims and other persons with disabilities.

Yet another object of the invention is to provide for the optional feature of making insertion of the various connecting pieces into the slots of the blocks easier. This will be provided for by having the openings of the slots slightly wider than the connecting pieces are thick.

A further object of the invention is to allow for the patterns for the various components to be such that the resulting blocks can be manufactured to any desired physical size.

Another object of the invention is to provide for optional holes to be cut through the patterns that will become the blocks. These holes will be positioned in a corresponding manner on opposing sides of the blocks. This will allow the installation of various shafts for the installation of wheels in the projects being constructed by children.

Still another object of the invention is to allow children, under adult supervision, to create additional components by cutting them out of a suitable material such as cardboard. These components would most likely be in the form of side panels.

Yet another object of the invention is to aid in the teaching of engineering and construction in a classroom setting. Many principles of engineering and construction can be demonstrated using this system of blocks.

Other objects, features and advantages of the present invention will become apparent to those skilled in the art from the detailed description which follows. It should be understood, however, that the detailed description, while indicating preferred embodiment, is given as an example and not a limitation. Many changes and modifications to the invention are possible without departing from the spirit of the invention, and all such modifications are included.

BRIEF DESCRIPTION OF THE DRAWINGS

FIG. 17 shows a perspective view of a panel.

FIG. 18 shows a perspective view of a panel.

FIG. 19 shows a perspective view of a panel.

FIG. 20 shows a perspective view of a panel.

FIG. 21 shows a perspective view of a panel.

FIG. 22 shows a perspective view of a panel.

FIG. 23 shows a perspective view of a panel.

DETAILED DESCRIPTION OF THE PREFERRED EMBODIMENTS

Figure 1:
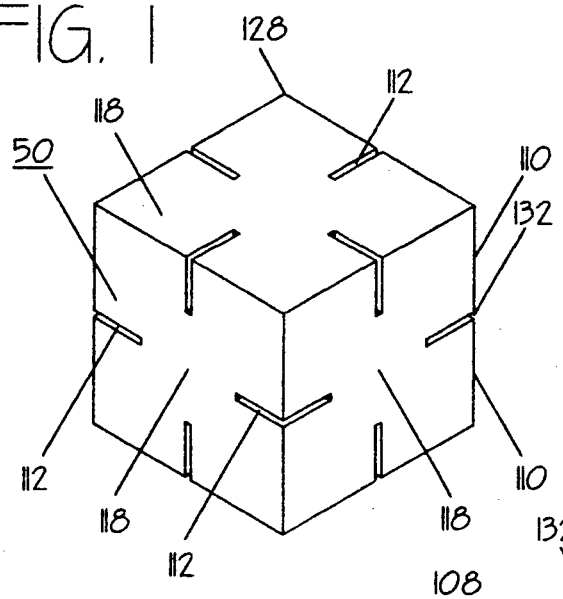
FIG. 1 shows a perspective view of a block as assembled.

The preferred embodiment will describe the components of the foldable toy block system which are the blocks, connectors, straps and the panels. It will describe the uniform dimensioning used by the various blocks and the unique alignment and spacing of the slots when the blocks are assembled and stacked in an orderly fashion. The various connectors and panels and the method of use of each will be explained and described. Finally the construction of the three dimensional blocks will be explained. It being understood that while only two general patterns of the blocks are described, many possible patterns exist and the invention includes all such possibilities.

Referring now to the drawings where like reference numerals refer to like elements throughout the various views.

FIG. 1 shows a perspective view of a block 50 which is constructed of a semi rigid material such as cardboard, plastic or foam. The block 50, having six sides 118 and eight corners 128 and twelve edges located between said eight corners 128. Said edges form the four edges for each of said sides 118. Said edges are each divided in two by the placement of slots 112. Said twelve edges thus are each divided into three separate sections comprised of two edges 110 with the width 132 of said slot 112 between said two edges 110. Said slots 112 being grouped together in sets of two located on each two abutting sides 118. Slot 112 being formed by penetrating into and through from one surface to the other of the said material comprising the block 50. Said slot 112 having a predetermined width 132 and being further comprised of a predetermined length being greater than the width 132 of the slot. Said slot 112 being thus comprised of an opening in the material of the block on the exterior of the block 50 and an opening in the material of the block on the interior of the block. Further comprised of an open end where the slot 112 intercepts the edge of the surface 118 and having a closed end where slot 112 reaches its predetermined length from said open end. Slot 112, being formed at a right angle, that is a ninety degree angle, to the edge of surface 118 and meets and further joins with a companion slot 112 which exists on the abutting side 118. This pairing of slots 112 thus results in twelve set of two companion slots 112. Block 50 therefore has twenty-four slots 112.

Figure 2:
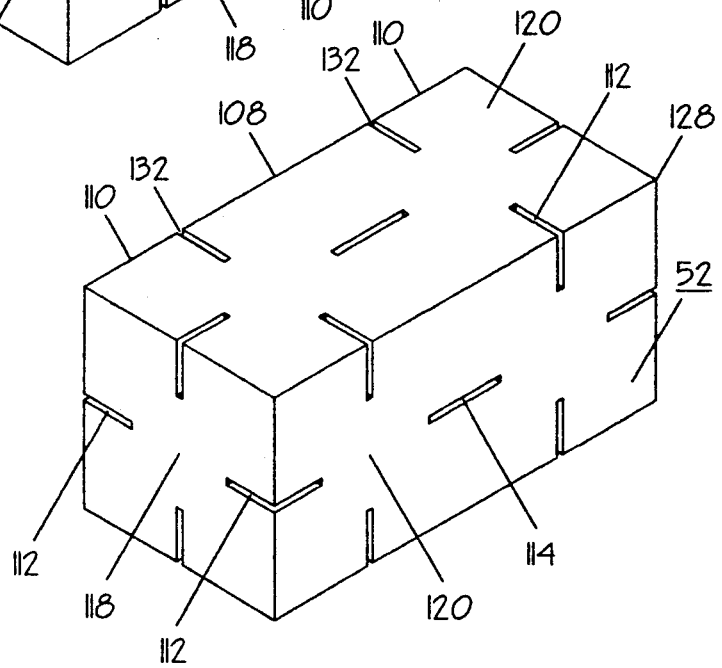
FIG. 2 shows a perspective view of a block as assembled.

FIG. 2 shows a perspective view of a block 52 which is similar to the block 50 illustrated in FIG. 1 having two identical sides 118 at opposing ends of the block. These sides 118 are identical to sides 118 of block 50 illustrated in FIG. 1. Block 52 having four sides 120 which have a length of exact twice their width. It being understood that their width is the same as the length and width of the surface 118. It being understood that the location and position of the slots 112 on surfaces 118 are the same as on block 50 illustrated in FIG. 1. The four surfaces 120 each contact the two sides 118 on two of their opposing ends respectively. Each side 120 has one slot 112 on each of those edges which abut sides 118 positioned as the companion slots referred to in FIG. 1. In addition each side 118 has four corners 128. Each of these corners being one of the corners of two of the sides 120. It further being understood that there is an edge located where each companion pair of sides 120 connect. Therefore there are four of these edges. Each of these edges are divided by two companion sets of slots 112. The edge 110, having a predetermined measurement of length between the corner 128 and the edge of the slot 112. The edge 108 also has a predetermined measurement of length between the edges of the two slots 112. The measurement of length of edge 108 being exactly twice the measurement of length of edge 110. Each slot 112 on side 120 therefore has a companion slot on its abutting companion side. It being understood that each slot 112 contact the edge of its respective surface at a right angle, that is a ninety degree angle. It being understood that each slot 112 aligns and matches up with a companion slot on the abutting companion surface. Each of the four sides 120 also has a single slot 114 penetrating its surface. Each of these slots 114 is aligned with the length of the side 120 and do not extend to the edge of the side 120. It being understood that the width of slot 114 is the same as the width of slots 112. It further being understood that the length of slot 114 is greater than the length of slot 112. The slots 114 are each centered on its side 120.

Figure 3:
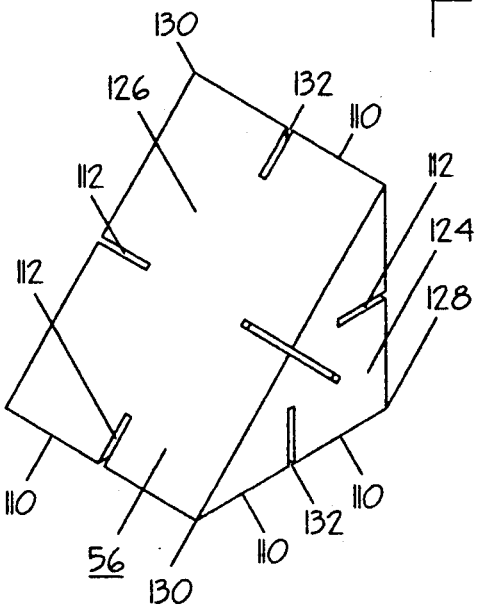
FIG. 3 shows a perspective view of a block as assembled.
Figure 4:
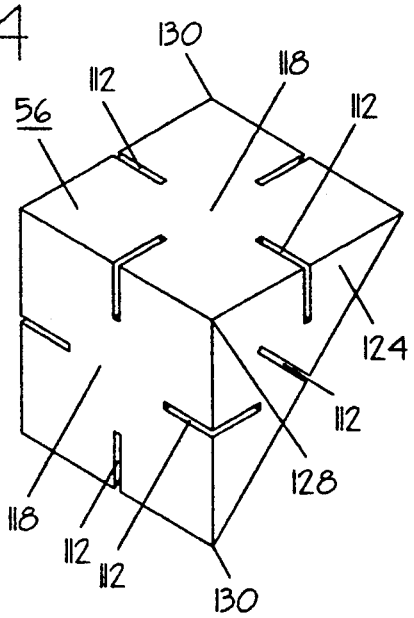
FIG. 4 shows a perspective view of a block as assembled.

FIG. 3 and FIG. 4 show two opposing perspective views of block 56. Block 56 has two sides 118 which are identical to sides 118 shown in FIG. 1 and FIG. 2 including the placement and location of the slots 112. Additionally block 56 has two opposing sides 124 which are the size and dimension of the divided side 118 when divided from one corner 128 to its opposing corner 128. The edges where sides 124 contact sides 118 have the same placement of slots 112 as the placement where sides 118 contact sides 118. Block 56 also has a fifth side 126. This side 126 contact each of the other fours sides of the block 56. This side has four slots 112 each located in the center of each of the four edges. Therefore block 56 has five sides and nine sets of companion slots for a total of eighteen slots. Each slot of these sets of slots 112 align and match up with each other and form right angles, that in ninety degree angles, to their respective edges.

Figure 5:
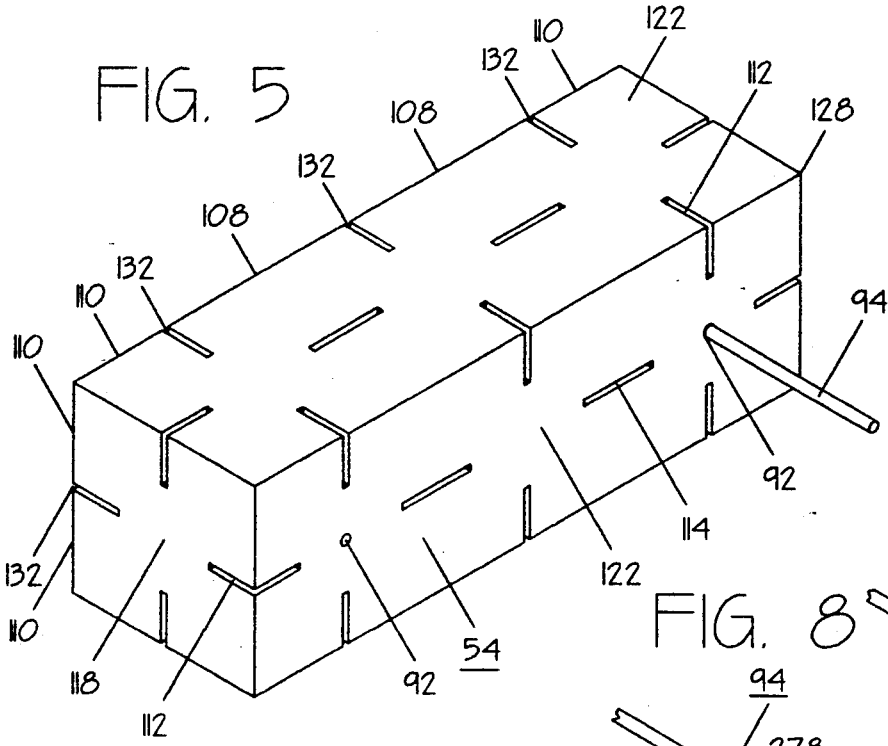
FIG. 5 shows a perspective view of a block as assembled.

FIG. 5 shows a perspective view of block 54 which is similar to block 52 illustrated in FIG. 2. The location, the spacing and the alignment of the slots 112 are similar to those describe for block 52 illustrated in FIG. 2. The slots on sides 118 are identical between the two views. The sides 122 shown in FIG. 5 correspond to the sides 120 shown in FIG. 2. The difference being that where sides 120 were twice the length of the dimension of sides 118, side 122 shown in FIG. 5 is three times the length of sides 118. There is also the inclusion of an additional set of slots 112 on each of the sides 122 when compared to side 120 shown in FIG. 2. These additional slots maintain the standardized spacing used in FIG. 2 and are aligned in pairs. Therefore block 54 has forty slots 112 in twenty matched sets. Additionally each side 54 has two slots 114. These slots are the same dimensions as described for FIG. 2. There placement has them aligned and centered along the length of side 122. The center of the two slots 114 are the same distance apart as the length of edge 108.

Figure 6:
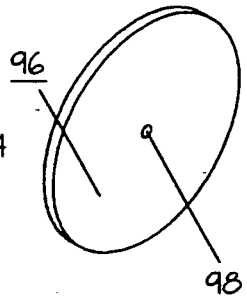
FIG. 6 shows a perspective view of a wheel.
Figure 7:
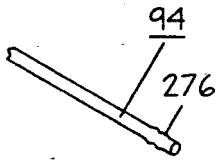
FIG. 7 shows a perspective view of a shaft.
Figure 8:
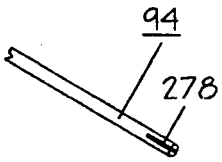
FIG. 8 shows a perspective view of a shaft.

Optionally each of the blocks could have a corresponding set of holes 92 bore through any two opposing sides. This is illustrated in FIG. 5 which show two facing holes 92 on side 122 with the corresponding holes 92 hidden from view on the opposing side 122. Through a set of these corresponding holes 92 would be inserted a shaft 94 for reception of wheels 96 using hole in wheel 98 shown in FIG. 6. The purpose of the wheels 96 is to give the projects built from the system of blocks the ability to move. The wheel 96 would be held on by a method currently known in the art,such as a hump 276 on shaft 94 shown in FIG. 7 or a slot 278 in shaft 94 shown in FIG. 8.

It is the uniform dimensioning of the blocks and the unique spacing and alignment of the slots that allow the arranging of the blocks so that the slots of one block align with the slots of the other aligned blocks in the system. This allows the use of the various connectors, straps or panels to bind the blocks together to form a project.

FIG. 9 through FIG. 14 show various connectors use in the system of toy blocks. These connectors are formed of a resilient material. This resilient material will have the property of being slightly compressible. It being understood that the thickness 134 of these connectors is greater than the width of the slots 112 and 114 shown in FIGS. 1, 2, 3, 4 and 5. The purpose of the connectors is to allow them to be inserted in the slots 112 or 114. A further purpose of the connectors, being resilient and slightly thicker than the width of the slot, is to allow the connectors to be held relatively securely in the slot by friction.

Figure 9:
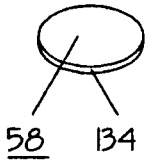
FIG. 9 shows a perspective view of a connecting member.
Figure 10:
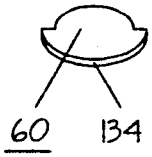
FIG. 10 shows a perspective view of a connecting member.
Figure 11:
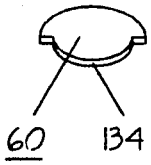
FIG. 11 shows a second perspective view of a connecting member.
Figure 12:
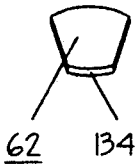
FIG. 12 shows a perspective view of a connecting member.
Figure 13:
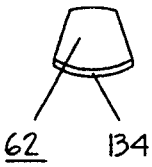
FIG. 13 shows a second perspective view of a connecting member.
Figure 14:
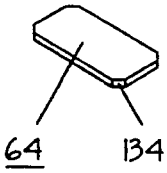
FIG. 14 shows a perspective view of a connecting member.

The connector 58 shown in a perspective view in FIG. 9 is round and is intended to be used in any set of pairs slots 112. It being understood that a part of the connector would be enclosed by the pair of slots 112. It further being understood that the projecting part of this connector could be used to connect other aligned blocks, using their slots 112, to the first. The connector 60 shown in opposing perspective views in FIG. 10 and FIG. 11 has the same diameter as the connector 58 shown in FIG. 9 with the exception that a section spanning one hundred and eighty degrees of its circumference, and penetrating a uniform distance, has been removed. This reduced section will be inserted in any of the slots 114. This design will allow the connector to be inserted and leave part of the connector projecting from the block without concern that the connector will fall into the block. FIG. 12 and FIG. 13 show two opposing perspective views of a connector 62. This connector is design to be used in any of the slots 112 or slots 114. FIG. 14 shows a perspective view of a connector 64. This connector is predominantly rectangular shaped with the edges slightly trimmed to aid in insertion into the slots. This connector can be used in any of the slots 112 or slots 114.

The straps are illustrated in FIGS. 15, 16, 24, 25, 27 and 28. These straps are all constructed of the same or similar material as the connectors 58, 60, 62 and 64 shown in FIG. 9, 10, 12 and 14 respectively, and have the same thickness 134.

Figure 15:
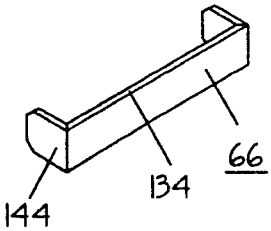
FIG. 15 shows a perspective view of a strap.
Figure 16:
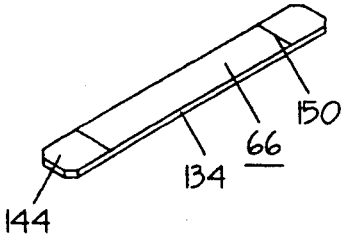
FIG. 16 shows a second perspective view of a strap.

FIG. 15 and FIG. 16 show two perspective views of a strap 66. FIG. 16 shows fold lines 150 which are spaced apart approximately the distance of the length of edge 108 shown in FIG. 2 and FIG. 5. This will allow the folding of the ends of the strap to an angle of ninety degrees at the fold lines 150. This folding process is shown in FIG. 15. The strap then can have its opposing ends inserted into any of the slots 112 or slots 114 on blocks that have been assembled and aligned with each other.

FIG. 17 through FIG. 23 show various center connect panels used in the system of toy blocks. These panels each have at least one extending member for the insertion into the slots 112 or slots 114. These extending members diameter are no greater than the length of slot 114 shown in FIG. 2 and FIG. 5. These panels would be installed in the projects built of the toy blocks so that they extend from a side of a block at a ninety degree angle. Therefore the blocks that they would be connected to would not have any of their surfaces in contact with the expansive surfaces of the panel. The panels are of one piece and have a thickness 134 consistent with the thickness of the connectors and straps used in the system. The panels are dimensioned so as to be proportionate to the standardized dimensions used by the various blocks. The extending members are positioned so that they will align with the various slots on the aligned and stacked blocks. These extending members being no wider than the slot 114, and understanding that the slots 112 extend to their respective edges, would fit in any slots used in the system.

FIGS. 17, 18 and 19 show perspective views of center connect panels 78, 74 and 76 respectively. They have a thickness 134 and various extending members 136, 138 and 140. The center connect panels 78, 74 and 76 have a generally triangular shape to their surfaces.

FIGS. 20, 21, 22 and 23 show perspective views of center connect panels 80, 82, 84 and 86 respectively. They have a thickness 134 and various extending members 136, 140 and 142. The center connect panels 80, 82, 84 and 86 have a generally rectangular shape to their surfaces.

Figure 24:
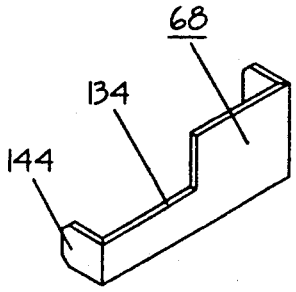
FIG. 24 shows a perspective view of a strap.
Figure 25:
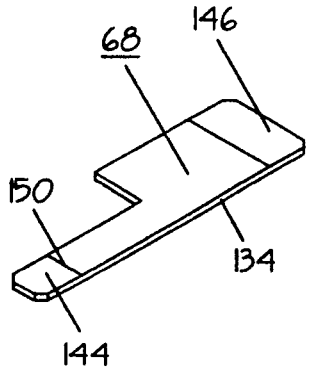
FIG. 25 shows a second perspective view of a strap.

FIG. 24 and FIG. 25 show two perspective views of strap 68. FIG. 25 shows the strap 68 laying flat with the fold lines 150 and FIG. 24 shows the strap 68 folded at the fold lines 150. It is in the folded condition that the strap would be used to connect two of the various blocks in the system which had been aligned one to the other. The end 146 of the strap 68 is wider than the end 144. This wider end 146 would be inserted into two of the aligned slots 112 on two of the aligned blocks.

Figure 26:
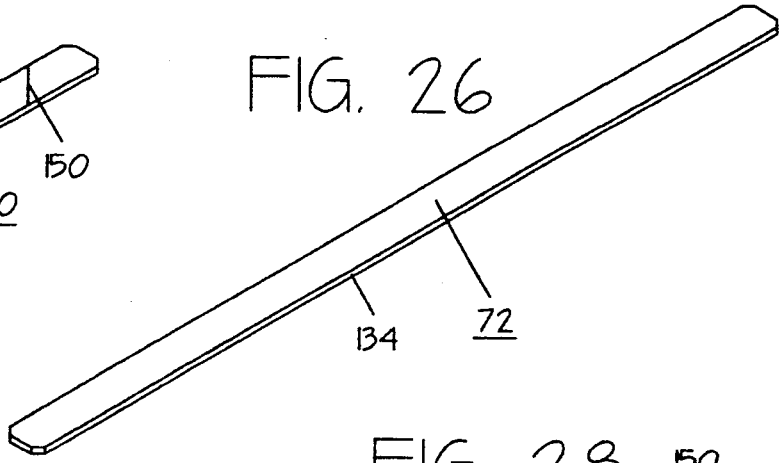
FIG. 26 shows a perspective view of a spanner.

FIG. 26 shows a perspective view of a spanner 72 having a thickness of 134. This spanner 72 would be inserted through a slot 112 on a block and exit the block through a opposing slot 112 on the same block. Then the spanner would penetrate a slot 112 on another block that had been aligned with the first block. This process would be continued to connect a number of blocks in the system rigidly together.

Figure 27:
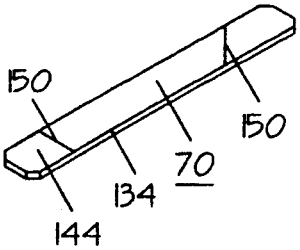
FIG. 27 shows a perspective view of a strap.

FIG. 27 shows a perspective view of a strap 70 which has a thickness of 134. This strap has fold lines 150 located at opposing ends of the strap 70. The strap 70 would be folded at its fold lines 150 and the resulting angled end would be inserted into a slot 112 in the block 56 shown in FIG. 4 and FIG. 5. The other end 144 would be inserted into a slot 112 on another block which had been aligned with the block 56 shown in FIG. 4 and FIG. 5.

Figure 28:
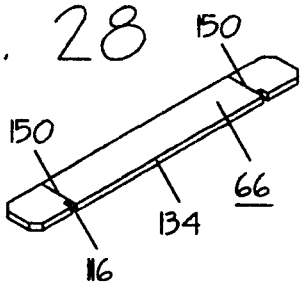
FIG. 28 shows a perspective view of a strap.

FIG. 28 shows a perspective view of a strap 66 which has a thickness of 134. This strap has the optional notch 116 which would allow the more secure connection of the blocks by allowing the strap 66 to be moved over and have the notch 116 connect to the blocks material at the end of the slots 112 or 114.

Figure 29:
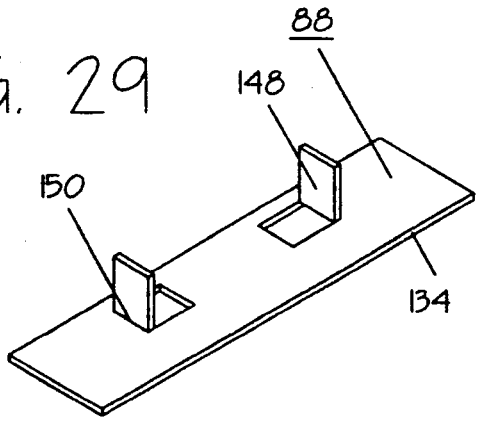
FIG. 29 shows a perspective view of a side panel.
Figure 30:
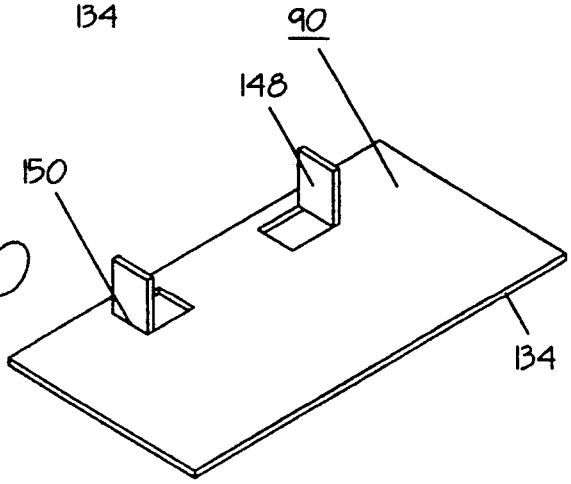
FIG. 30 shows a perspective view of a side panel.

FIG. 29 and FIG. 30 show two side connect panels 88 and 90 respectively. These panels have connecting tabs 148 which would extend at ninety degree angles when folded at fold lines 150 to the panels 88 and 90. These connecting tabs 148 would be spaced a uniform distance apart to allow insertion into slots 112 or 114 on aligned blocks.

Figure 31:
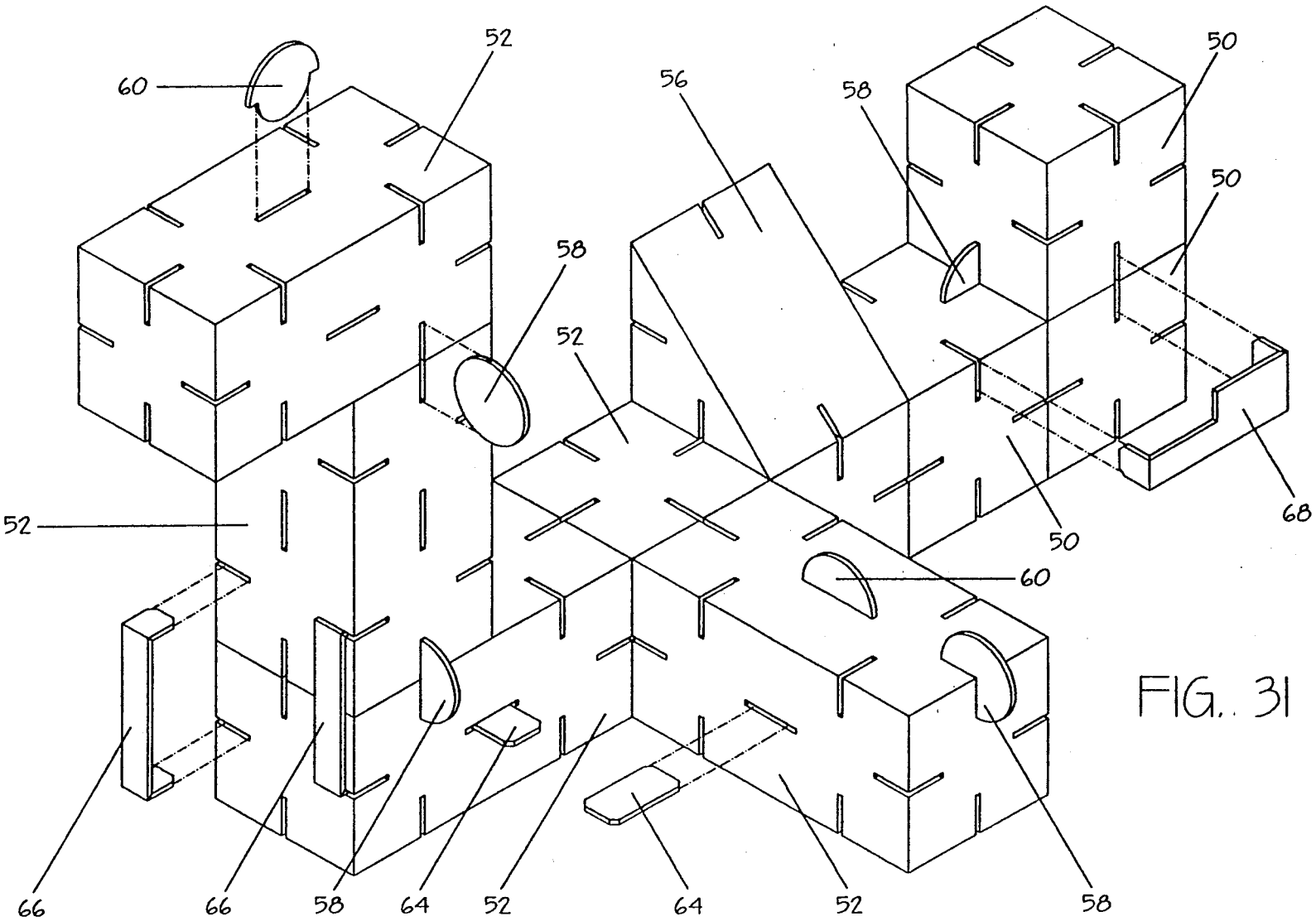
FIG. 31 shows a perspective view of a plurality of blocks, a plurality of connectors and a plurality of straps.

FIG. 31 shows a perspective view of a group of properly aligned blocks. This view clearly shows the relationship of the dimensioning of the blocks and the relationship of the placement of the various slots. This view shows three blocks 50, five blocks 52 and one block 56. Also shown inserted are three connectors 58, one connector 60, one connector 64 and one strap 66. Shown with projection lines for insertion are a connector 58, connector 60, connector 64, strap 66 and strap 68.

Figure 32:
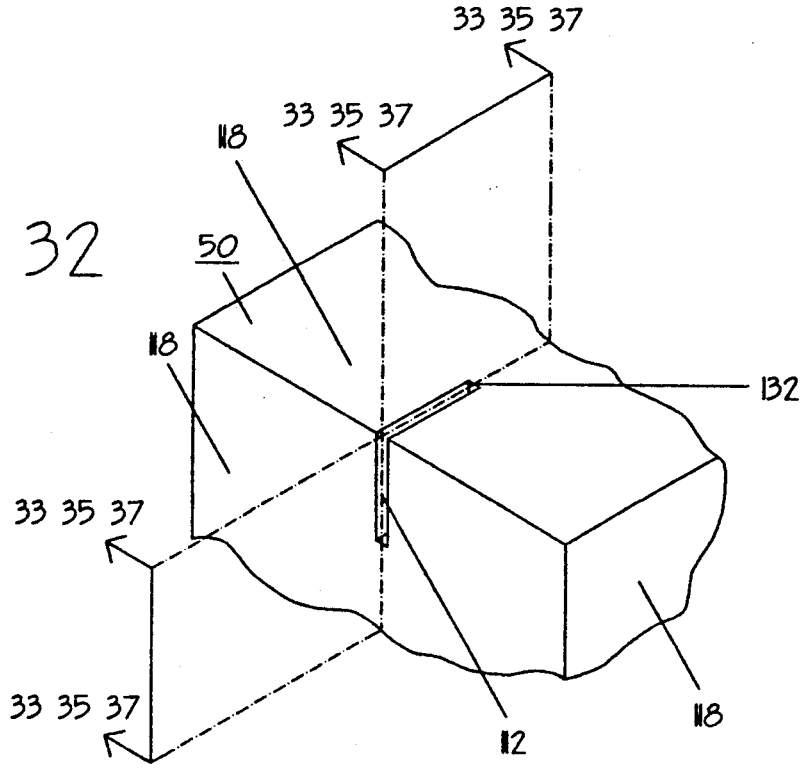
FIG. 32 shows a perspective view of a cutaway corner of a block.

FIG. 32 shows an enlarged perspective view of a cutaway corner of block 50. This view shows the three sides 118 and a slot 112 having a width of 132. Section lines used in FIG. 33, FIG. 35 and FIG. 37 are also shown.

Figure 33:
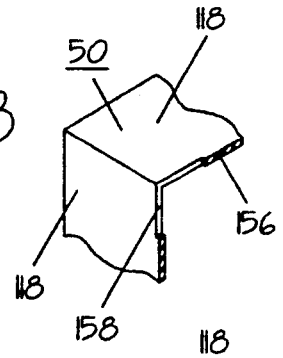
FIG. 33 shows a perspective view of a cutaway of a slot.
Figure 34:
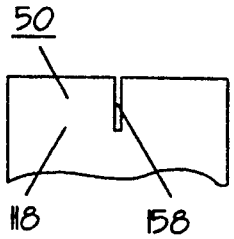
FIG. 34 shows a plan view of a slot.

FIG. 33 shows a sectional cutaway perspective view of a corner of block 50 as shown by the section lines in FIG. 32. FIG. 34 shows a plan view of the cutaway of block 50 shown in FIG. 32. The shape 158 of the slot 112 is shown in FIGS. 33 and FIG. 34 and is the shape of the slot 112 in the preferred embodiment. The shape 158 of the slot is such that its sides are straight and they extend from the edge created by the two sides 118 at right angles, that is ninety degree angles.

Figure 35:
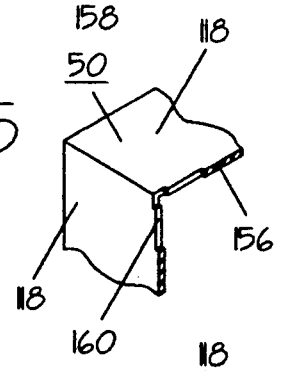
FIG. 35 shows a perspective view of a cutaway of a modified slot.
Figure 36:
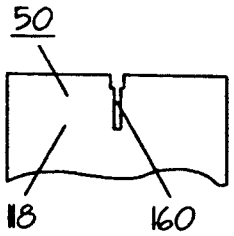
FIG. 36 shows a plan view of a modified slot.

FIG. 35 shows a sectional cutaway perspective view of a corner of block 50 as shown by the section lines in FIG. 32. FIG. 36 shows a plan view of the cutaway of block 50 shown in FIG. 32. The modified shape 160 of the slot is such that there is slightly more material removed on the opposing sides of the slot where it connects with the edge of the block created by the two surfaces 118. This shape of the slot is to allow an easier insertion of the various connectors, straps or the extending tabs as used on the various panels.

Figure 37:
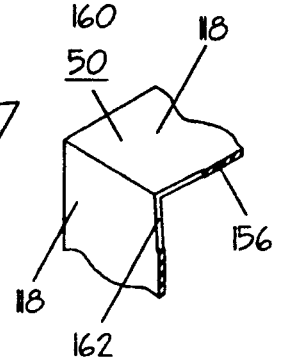
FIG. 37 shows a perspective view of a cutaway of a modified slot.
Figure 38:
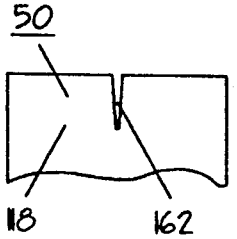
FIG. 38 shows a plan view of a modified slot.

FIG. 37 shows a sectional cutaway perspective view of a corner of block 50 as shown by the section lines in FIG. 32. FIG. 38 shows a plan view of the cutaway of block 50 shown in FIG. 32. The modified shape 162 of the slot is such that there is a tapering of the slot as it extends away from the edge formed by the sides 118. It being understood that the opening of the slot would be slightly wider than the width 134 of the various connectors, various straps or extending member of the various panels. This shape of the slot is to allow an easier insertion of the various connectors, straps or the extending tabs as used on the various panels.

Fold lines 152 are included in FIGS. 39, 41, 43 and 45. It being understood that the pattern shown in these figures are all of one piece and the fold lines 152 are indentations or partial cuts in the various patterns. It further being understood that the sections enclosed by the various edges of the patterns and the various fold lines 152 are being referred to as panels. It being understood that both sides of each panel will have the same reference numeral applied.

Figure 39:
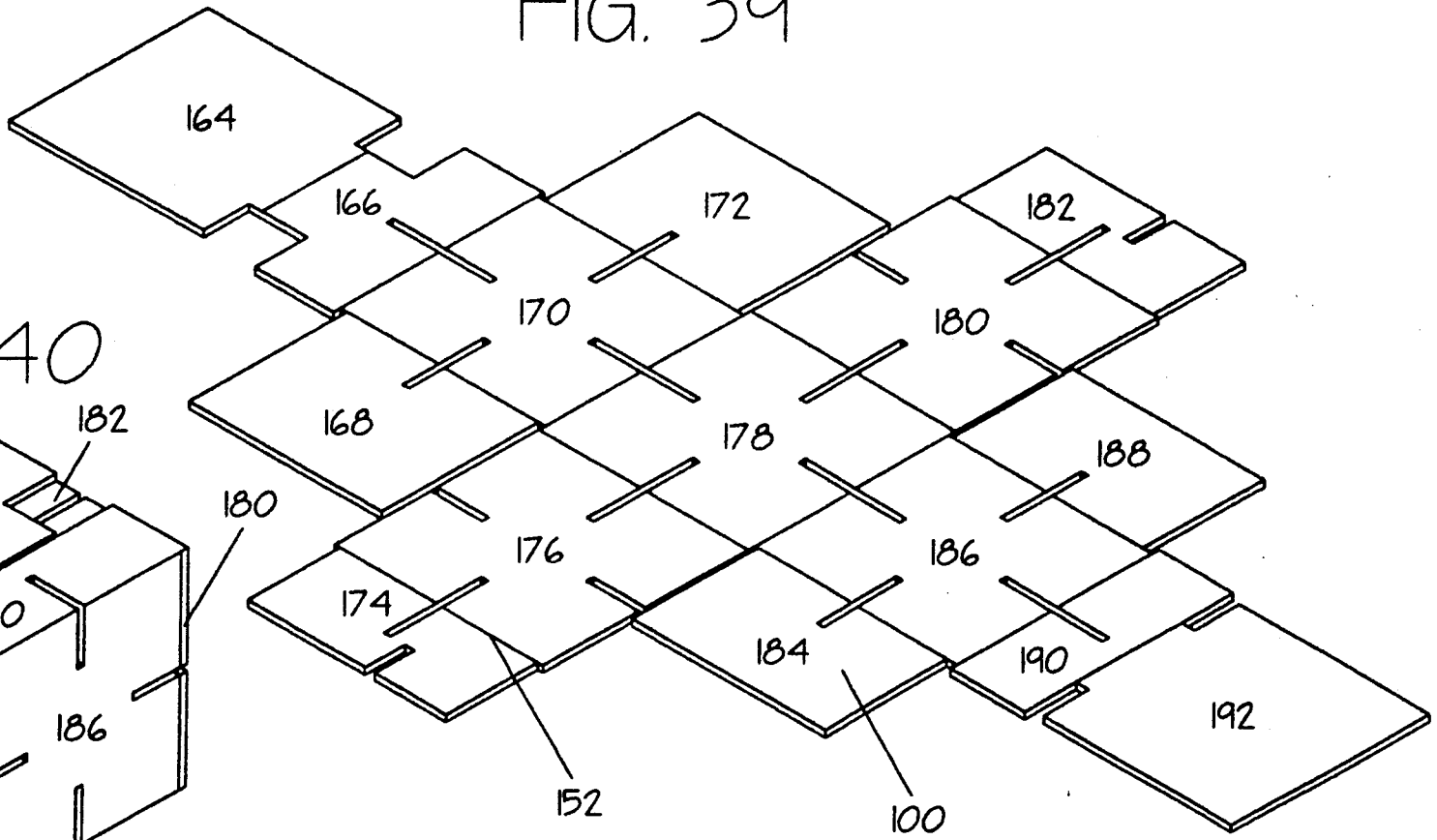
FIG. 39 shows a perspective view of a pattern for a block.
Figure 40:
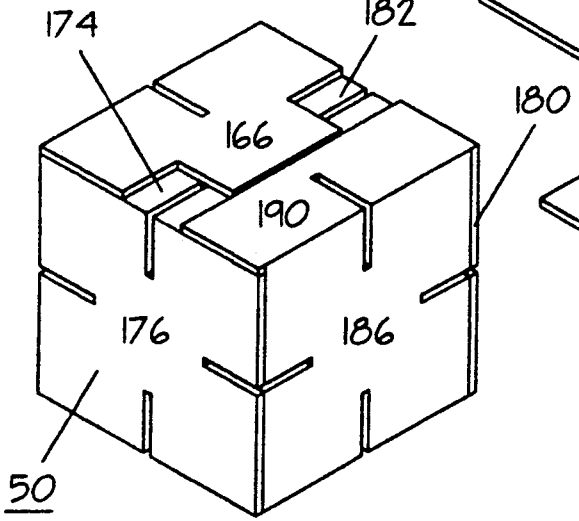
FIG. 40 shows a perspective view of the assembled block that would be created by the pattern of FIG. 39.

FIG. 39 shows a perspective view of a pattern with the various panel reference numerals displayed which when properly folded at the various fold lines 152 will become block 50. FIG. 40 shows a perspective view of block 50 in its assembled state with the various panel reference numerals.

The assembly of the block 50 consist of the following steps. Referring to FIG. 39 panel 164 would fold up at a ninety degree angle to panel 166. Panels 168 and 172 would fold up and over more than ninety degrees so as to be suspended over panel 170. Panel 166 would then fold up at a ninety degree angle to panel 170 so that panel 164 was suspended over panel 170 and panel 164 would thus hold panels 168 and 172 suspended between panel 170 and panel 164. Similarly panel 192 would fold up at a ninety degree angle to panel 190. Panels 184 and 188 would fold up and over more than ninety degrees so as to be suspended over panel 186. Panel 190 would then fold up at a ninety degree angle to panel 186 so that panel 192 was suspended over panel 186 and panel 192 would thus hold panels 184 and 188 suspended between panel 186 and panel 192. The assembly of panels 164, 166, 168, 170 and 172 would then be folded up at a ninety degree angle to panel 178. At this point an end of panel 164 would be in contact with the upper surface of panel 178. Similarly the assembly of panels 184, 186, 188, 190 and 192 would then be folded up at a ninety degree angle to panel 178. At this point an end of panel 192 would be in contact with the upper surface of panel 178. Then panel 182 would be folded up at a ninety degree angle to panel 180 and panel 180 would be folded up at a ninety degree angle to panel 178. During this folding process the extended tab which is panel 182 would be inserted into the slot that has been created by the previous steps. Then panel 174 would be folded up at a ninety degree angle to panel 176 and panel 176 would be folded up at a ninety degree angle to panel 178. During this folding process the extended tab which is panel 174 would be inserted into the slot that has been created by the previous steps. The proceeding steps create the block 50 illustrated in FIG. 40.

Figure 41:
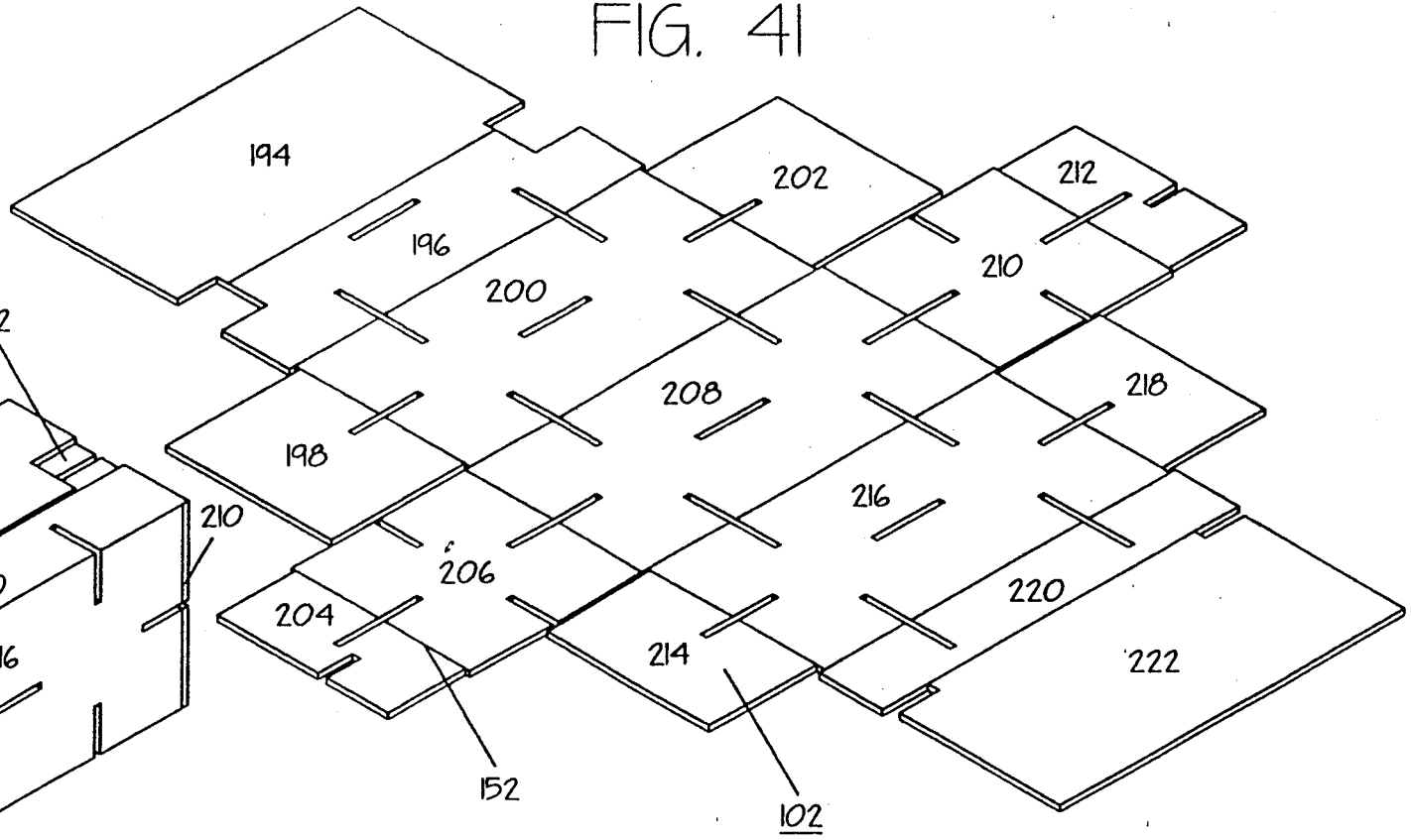
FIG. 41 shows a perspective view of a pattern for a block.
Figure 42:
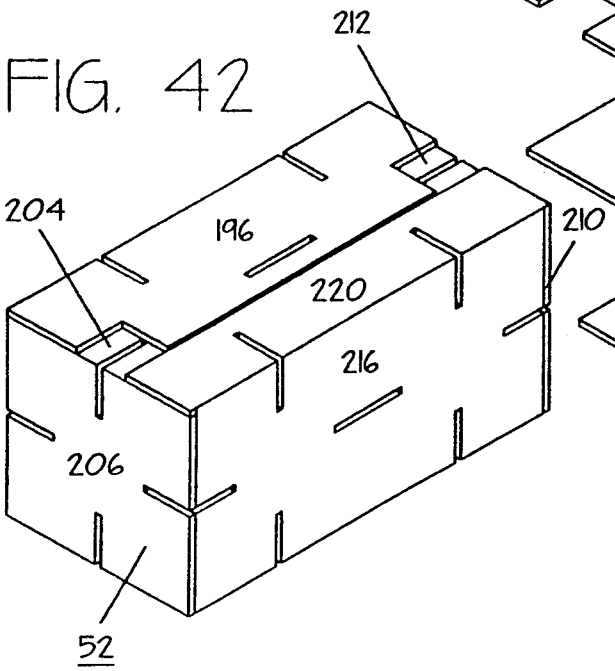
FIG. 42 shows a perspective view of the assembled block that would be created by the pattern of FIG. 41.

FIG. 41 shows a perspective view of a pattern with the various panel reference numerals displayed which when properly folded at the various fold lines 152 will become block 52. FIG. 42 shows a perspective view of block 52 in its assembled state with the various panel reference numerals.

The assembly of the block 52 consist of the following steps. Referring to FIG. 41 panel 194 would fold up at a ninety degree angle to panel 196. Panels 198 and 202 would fold up and over more than ninety degrees so as to be suspended over panel 200. Panel 196 would then fold up at a ninety degree angle to panel 200 so that panel 194 was suspended over panel 200 and panel 194 would thus hold panels 198 and 202 suspended between panel 200 and panel 194. Similarly panel 222 would fold up at a ninety degree angle to panel 220. Panels 214 and 218 would fold up and over more than ninety degrees so as to be suspended over panel 216. Panel 220 would then fold up at a ninety degree angle to panel 220 so that panel 222 was suspended over panel 216 and panel 222 would thus hold panels 214 and 218 suspended between panel 216 and panel 222. The assembly of panels 194, 196, 198, 200 and 202 would then be folded up at a ninety degree angle to panel 208. At this point an end of panel 194 would be in contact with the upper surface of panel 208. Similarly the assembly of panels 214, 216, 218, 220 and 222 would then be folded up at a ninety degree angle to panel 208. At this point an end of panel 222 would be in contact with the upper surface of panel 208. Then panel 212 would be folded up at a ninety degree angle to panel 210 and panel 210 would be folded up at a ninety degree angle to panel 208. During this folding process the extended tab which is panel 212 would be inserted into the slot that has been created by the previous steps. Then panel 204 would be folded up at a ninety degree angle to panel 206 and panel 206 would be folded up at a ninety degree angle to panel 208. During this folding process the extended tab which is panel 204 would be inserted into the slot that has been created by the previous steps. The proceeding steps create the block 52 shown in FIG. 42.

Figure 43:
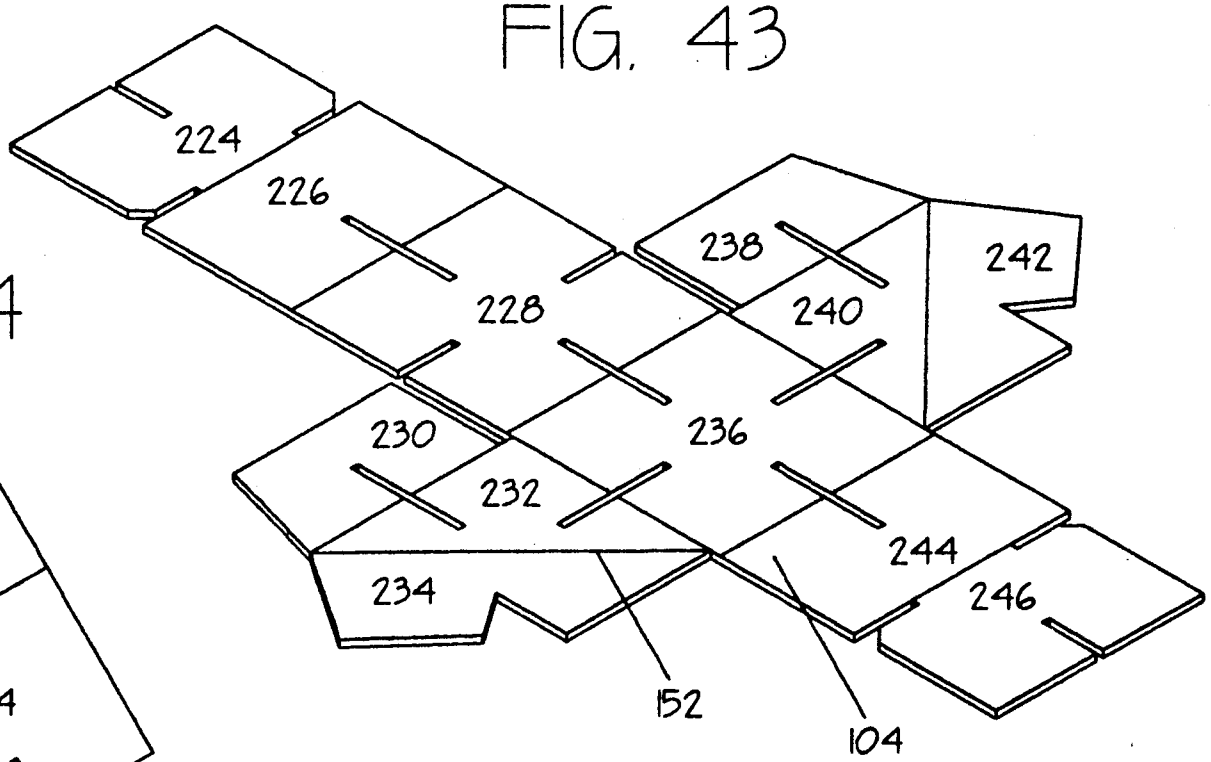
FIG. 43 shows a perspective view of a pattern for a block.
Figure 44:
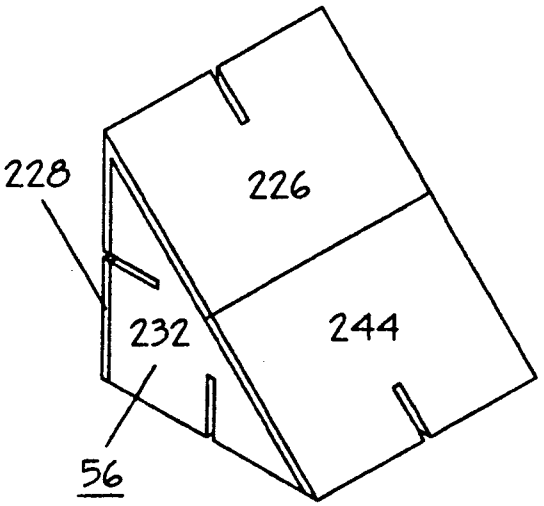
FIG. 44 shows a perspective view of the assembled block that would be created by the pattern of FIG. 43.

FIG. 43 shows a perspective view of a pattern with the various panel reference numerals displayed which when properly folded at the various fold lines 152 will become block 56. FIG. 44 shows a perspective view of block 56 in its assembled state with the various panel reference numerals.

The assembly of the block 56 consist of the following steps. Panel 246 is folded up slightly and panel 244 is folded up slightly and these two panels then are folded up and over until the end of panel 246 farthest away from its fold line is in contact with the fold line between panel 228 and panel 236. Then similarly panel 224 is folded up slightly and panel 226 is folded up slightly and these two panels then are folded up and over until the end of panel 224 farthest away from its fold line is in contact with the fold line between panel 228 and panel 236. Then the assembly of panels 224, 226 and 228 is folded up until panel 224 is in contact with panel 246. At this point panel 228 will be at a ninety degree angle to panel 236. Panel 230 is then folded up to form a ninety degree angle to panel 232. Panel 234 is folded up to form a ninety degree angle to panel 232. Panel 232 with panel 230 and panel 234 are then folded up to a ninety degree angle to panel 236. During this process panel 230 and panel 234 are inserting into the opening created by the previous steps. Similarly panel 238 is then folded up to form a ninety degree angle to panel 240. Panel 242 is folded up to form a ninety degree angle to panel 240. Panel 240 with panel 238 and panel 242 are then folded up to a ninety degree angle to panel 236. During this process panel 238 and panel 242 are inserting into the opening created by the previous steps. The preceding steps create the block 56 shown in FIG. 44.

Figure 45:
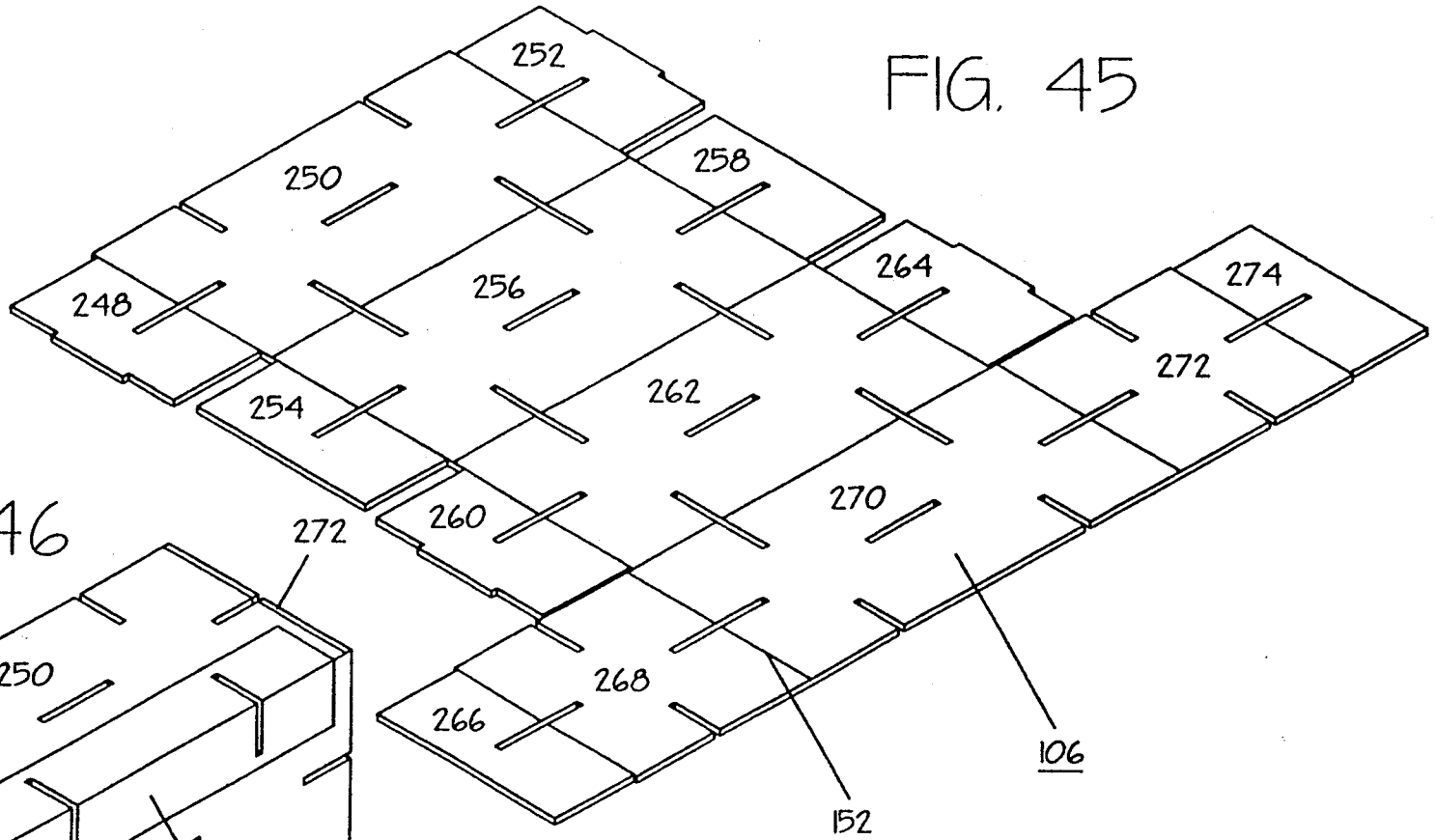
FIG. 45 shows a perspective view of a modified pattern for a block.
Figure 46:
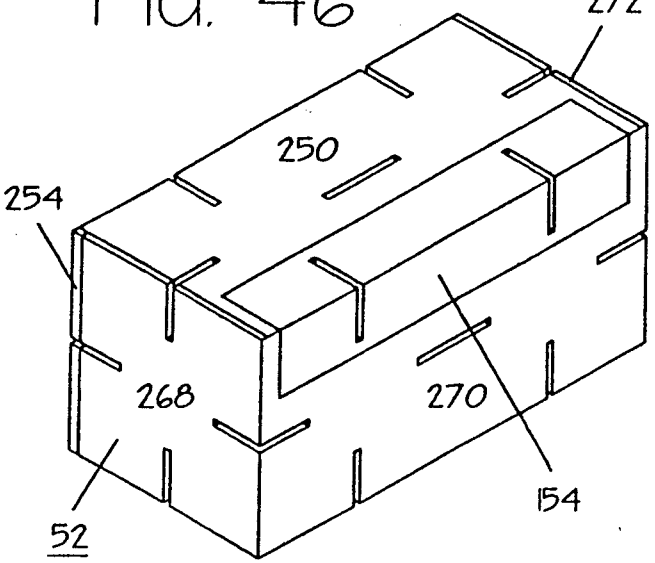
FIG. 46 shows a perspective view of the assembled modified block that would be created by the pattern of FIG. 45.

FIG. 45 and FIG. 46 show perspective views of a modified form of the invention in the form of the pattern that will become the block. In this modified form of the invention the resulting block will not have any interior walls as are found on the blocks constructed using the patterns of the preferred embodiment. This modified form of the invention will be secured with tape 154 and the insertion of the various extending tabs.

FIG. 45 shows a perspective view of a pattern with the various panel reference numerals displayed which when properly folded at the various fold lines 152 will become block 52. FIG. 46 shows a perspective view of block 52 in its assembled state with the various panel reference numerals.

The assembly of the block 52 using the pattern shown in FIG. 45 consist of the following steps. The group of panels 248, 250 and 252 will be folded up at a ninety degree angle to panel 256. Then the group of panels 254, 256 and 258 along with the attached group of panels 248, 250 and 252 will be folded up at a ninety degree angle to panel 262. The group of panels 266, 268, 270, 272 and 274 will then be folded up at a ninety degree angle to panel 262. At this time the edge of panel 270 that is not a fold line and the edge of panel 250 that is not a fold line will be in contact. Tape 154, shown in FIG. 46, will then be used to secure the edges of these two panels together. Panel 254 will then be folded in so as to be in contact with panel 256. Panel 248 and panel 260 will then both be folded in at a ninety degree angle over panel 254. Panel 266 will then be folded in at a ninety degree angle and panel 268 with panel 266 attached will be folded in at a ninety degree angle. During this process the extended tab which is panel 266 will be inserted into the slot created by the previous steps. Similarly panel 258 will then be folded in so as to be in contact with panel 256. Panel 252 and panel 264 will then both be folded in at a ninety degree angle over panel 258. Panel 274 will then be folded in at a ninety degree angle and panel 272 with panel 274 attached will be folded in at a ninety degree angle. During this process the extended tab which is panel 274 will be inserted into the slot created by the previous steps. The preceding steps create the block 52 shown in FIG. 46.

I claim:

1. A building block set of hollow folded building blocks and connectors comprising, more than one building block assembled from flat foldable sheet material, when assembled each block being essentially hollow having corners, edges, end faces and other faces, the end faces being essentially square;

at least one edge on each face having at least one connector slot, each connector slot comprising aligned slots in adjacent faces, each said aligned slot having a set width;

a plurality of edge connectors comprising planar members of an established thickness, said thickness being approximately the same as said set width, so that when said connectors are inserted in a connector slot the edge connector is engaged by said aligned slots while penetrating into said hollow interior, thereby permitting adjacent connector slots of adjacent and aligned blocks to be engaged by a single connector as said connector is engaged by at least two faces of each of said aligned and adjacent blocks.

2. The building block set of claim 1 wherein said edge connectors are essentially circular.

3. The building block set of claim 1 wherein said aligned slots taper from said set width to a smaller width from an edge toward an inner portion of said face where said aligned slot is mounted.

4. The building block set of claim 1 wherein the edge connector slots have aligned slots perpendicular to said edge.

5. The building block set of claim 1 including strap connectors formed from planar material of said established thickness, each said strap connector including foldable tabs on each end of said strap connector, said strap connector of sufficient length to allow said foldable tabs to engage non-adjacent connector slots of adjacent building blocks.

6. The building block set of claim 5 wherein said strap connectors include lock slots on said tabs allowing said tab to be moved within a connector slot to engage an end of said connector slot and a portion of that face where said slot is formed.

7. The building block set of claim 1 wherein at least one of said other faces includes a face connector slot, said face connector slot having a width equal to said set width and a length less than twice that length defined by said aligned slots, and face connectors made of planar material of said established thickness having shoulders to prohibit complete insertion through said face connector slot.

8. The building block set of claim 1 wherein said flat foldable sheet material is semi-rigid.

9. The building block set of claim 1 including a plurality of wheels and rods, said rods engagable with said wheels to act as axles, and apertures in opposing faces of one of said assembled building blocks, said apertures of sufficient width to accept one of said rods.

10. The building block set of claim 1 wherein said aligned slots feature an end notch, said notch being of a width greater than said set width and said established thickness to enable easier initial insertion of said edge connectors.

11. The building block set of claim 1 including connector panels that are of said established thickness, each said panel including extending members mounted upon panel sides allowing engagement of said extending members in either of said edge connector slots and said face connector slots.

* * * * *